United States Patent [19]

Zoellner

[11] Patent Number: 5,007,869

[45] Date of Patent: Apr. 16, 1991

[54] PROP-SAVER (PROPELLER GUARD DEVICE)

[76] Inventor: Allen W. Zoellner, P.O. Box 283, Topock, Ariz. 86436

[21] Appl. No.: 555,373

[22] Filed: Jul. 19, 1990

Related U.S. Application Data

[63] Continuation-in-part of Ser. No. 492,960, Mar. 13, 1990, abandoned.

[51] Int. Cl.[5] ..... B63H 5/16

[52] U.S. Cl. ..... 440/71; 114/274; 440/66; 440/900

[58] Field of Search ..... 440/66, 71, 72, 67, 440/900; 114/145 A, 145 R, 274

[56] References Cited

U.S. PATENT DOCUMENTS

| | | | |
|---|---|---|---|
| 1,226,400 | 5/1917 | Smith | 440/900 |
| 1,549,564 | 8/1925 | Slocum | 440/66 |
| 1,869,977 | 8/1932 | Modin | 440/71 |
| 2,717,570 | 9/1955 | Willoughby | 440/71 |
| 3,099,240 | 7/1963 | Montague | 114/274 |
| 3,433,195 | 3/1969 | Poole | 114/274 |
| 4,205,618 | 3/1980 | Olsson | 440/66 |
| 4,235,183 | 11/1980 | Evinrude | 440/71 |
| 4,597,742 | 7/1986 | Finkl | 440/71 |

*Primary Examiner*—Sherman Basinger
*Assistant Examiner*—Thomas J. Brahan

[57] ABSTRACT

Disclosed herein is a propeller guard device, including a laterally extending fin and a vertical extension, or sleeve. The fin and sleeve could be manufactured as a singular item. The vertical sleeve is attached to the midline area of the fin, with the leading edge of the sleeve being generally co-terminus with the leading edge of the fin. The fin is at least as wide as the rotational path of the propeller blades. The singular fin extends laterally on either side of the sleeve in a generally coplanar relationship. The leading edge of the fin is elevated from three to five degrees higher than the trailing edge of the fin. The trailing edge of the fin is located forwardly of the rotational path of the propeller blades, or is lengthened and extends towards the rear of the device to the extent of being even with the midline of the rotational path of the propeller blades.

3 Claims, 1 Drawing Sheet

FIG. 1
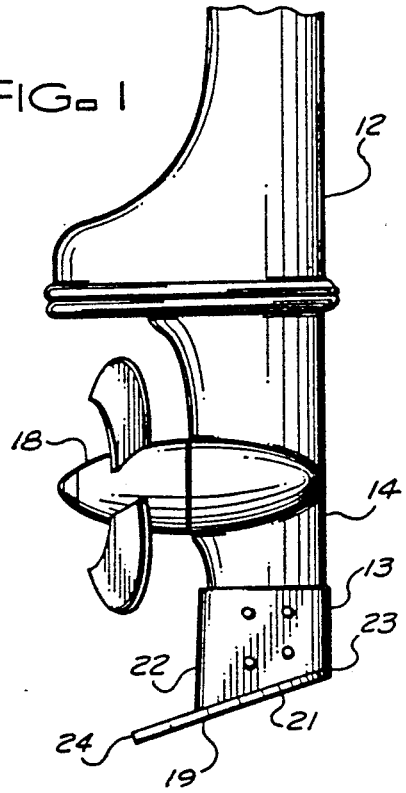
FIG. 2
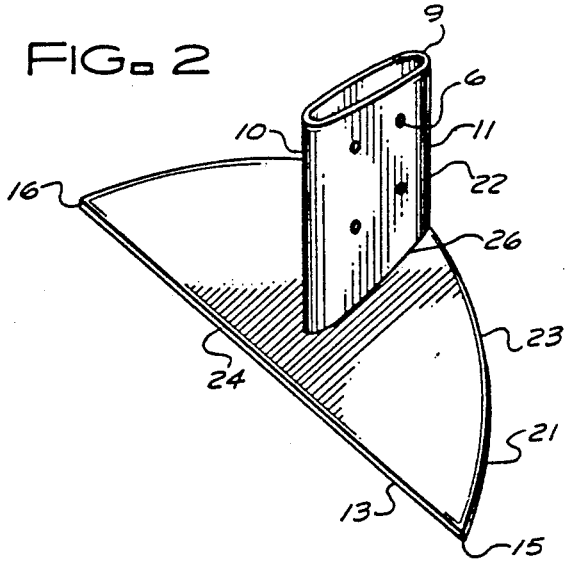
FIG. 3
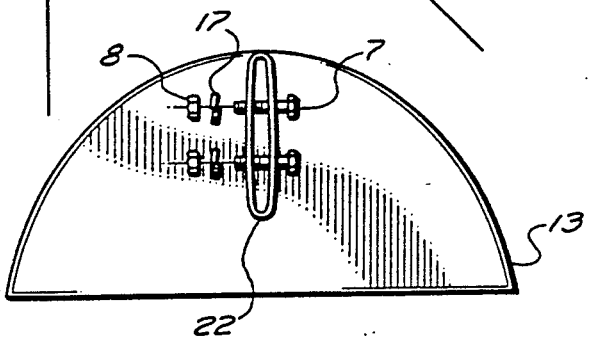
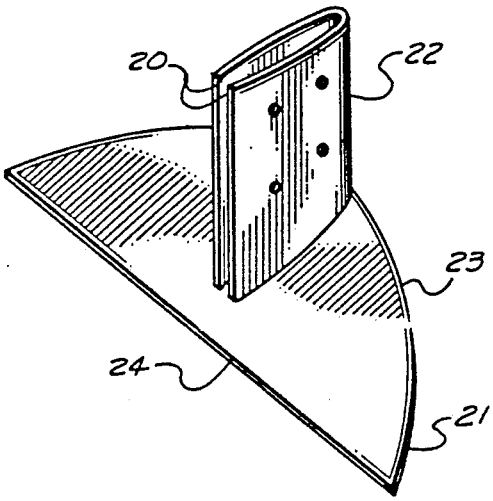
FIG. 4
FIG. 5
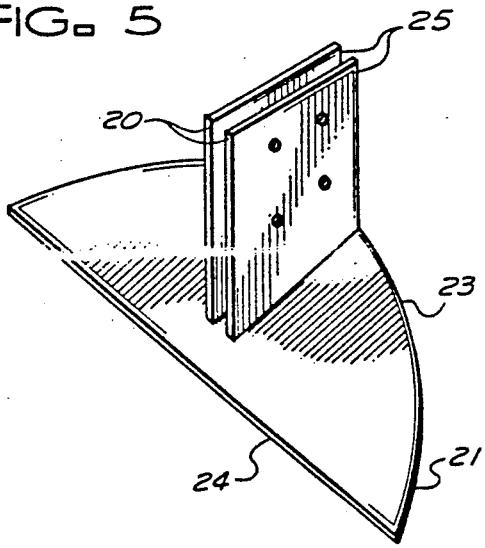

PROP-SAVER (PROPELLER GUARD DEVICE)

This application is a continuation in part of my prior copending application, Ser. No. 07/492,960, filing data Mar. 13, 1990, now abandoned.

SUMMARY OF THE INVENTION

My invention satisfies a current consumer need for an inexpensively manufactured, portable device, that protects propellers and shear pins from submerged objects, offers a hydrofoil effect, more stability for moving vessels, an ability to get on plane more quickly, and increased fuel economy.

The primary objective of this invention is to protect or guard the propellers on an existing marine motor via the addition of a new device. The device is a simple means of protecting the propeller against damage by submerged objects such as rocks, logs and/or other debris. Another principal feature of the device is that it improves fuel economy and cruising range by staying on plane at lower RPM. The lower horizontal fin is installed with a three to five degree downward and rearward pitch. This effectively lifts the stern up and brings the bow down, thus decreasing drag and increasing speed. The position of the lower fin with respect to the propeller and its shape assists in diverting most types of debris away from the propeller, thus reducing damage, as well as providing a hydrofoil effect.

This device differs from other inventions because of its shape, design, placement, combination of benefits previously unavailable, and in that it is a separate object that is to be attached to the skeg. The multiple benefits of this device were accidentally discovered as I attempted to invent a propeller protection device for my personal use.

Previously proposed propeller guards do not offer the particular combination of positive attributes that are incorporated into this invention. This propeller guard is strong, durable, thoroughly reliable and efficient in operation, inexpensive to manufacture, easy to install or remove, and is adaptable to most current marine motors.

BRIEF DESCRIPTION OF THE DRAWINGS

FIG. 1 is an overall view of the device after it has been installed on the skeg of an average marine motor. This drawing shows proper placement of the device on the skeg.

FIG. 2 depicts a perspective view of the device embodying various features of the invention. In this view, the device is shown as detached from the skeg.

FIG. 3 is a top plan view of the invention, as viewed before attachment to a skeg.

FIG. 4 is an alternate perspective view, identical to that of FIG. 2 with the singular exception that in this view the trailing edge of the sleeve is left open for ease of attachment.

FIG. 5 is also a perspective view that is in all aspects the same as in FIG. 4 except that this option portrays both the leading and the trailing edges of the sleeve "open."

Before explaining the embodiments of the invention in more detail, I would like it to be understood that this invention is not limited in its application to the details of construction and/or the arrangements of the components set forth in the following description or in the illustrated drawings. This invention is capable of other embodiments and of being practiced or carried out in various ways. Also, please understand that the phraseology and/or terminology used herein is for the purposes of description only and should not be regarded as limiting.

DETAILED DESCRIPTION

I have invented a new device to protect the propeller and shear pins on marine vessel motors. The device is simple and has no moving parts. Other attributes were discovered during the research and development phases of this invention.

My idea is to protect propeller blades (and/or shear pins) by attaching a fin below the skeg. This fin would be the first object to encounter a submerged object and would absorb the initial shock of impact. This should deflect most damage from the propeller blades, and in most cases, would keep the shear pin from breaking off during impact.

One very important feature of this invention is that the fin is at least as wide as the circumference of the path of the propeller blades. When the fin hits a submerged object, it often lifts the entire motor casing high enough in the air to clear the submerged object. In a worst case scenario, the lift would not occur. The fin should then absorb most of the damage instead of the propeller blades.

I discovered that by angling the leading edge of the fin higher than the trailing edge of the fin, I increased my gas mileage by a marginal amount. I also found an increase in the stability of the vessel when using my device. A hydrofoil effect was created by the above mentioned angle of the fin and the general design of the device, thus enabling the marine vessel to get on plane much faster and use less gas.

HOW MY INVENTION DIFFERS FROM OTHERS

My invention is new because of many factors. The design and placement of the device is unique, but more importantly, the design allows complex benefits to the user. The factors of portability and inexpensive production are beneficial. The amount of protection afforded the propeller and shear pins because of the width and strength and placement of the fin is very important also. The ease of installation and removal are helpful. I created a fin that is as wide as the rotational path of the propeller blades to give fuller protection to the blades. The hydrofoil effect, increase in speed, fuel economy, and the ability to get on plane much faster are some of its best features. But, most importantly, these features are all combined into one new device. It is very sturdy because of its size, shape, and the material it is made of. It will be offered to the public as a separate item to be added to existing marine vessel motors. It has no moving parts. It can be attached to almost any marine motor on the market. It can also be easily removed for replacement if damaged.

I have never encountered a propeller guard device that also has a hydrofoil effect, nor one with these multiple attributes. The normal problem with propeller guards is that they created drag and reduced speed and often lessened stability of the vessel. My discovery of the exact angle of installation and the design I created for the fin and sleeve have overcome these obstacles. I designed this device so that the leading edge of the fin about ¼" to ½" higher than the trailing edge of the fin. This means that the side of the fin to first encounter the water will have a higher level than that of the opposing edge of the fin, which leaves the water last. This seems to give a lift to the entire marine motor assembly. It also reduces drag, and creates a hydrofoil effect, which in turn, increases power, speed, stability, and gas mileage.

Patents have been granted for devices relating to outboard motors that feature propeller guards as an integral part of the outboard motor itself. There are also patents for items that are extraneous to the outboard motor, and yet are designed in various ways to protect or guard the propeller. Their designs differ greatly from mine, and to my knowledge, no other invention offers the complex multiplicity of benefits that my device offers. Existing devices do not have the same design, complex benefits, or degree of protection that my invention offers.

The design, multiple advantages, placement, and effectiveness of my invention is unique. It is separate from the existing marine motor, and yet the design permits a unique strength for a propeller guard. The placement of my device affords increased gas mileage and does not appreciably impair, and usually improves, the stability of a marine vessel in usage. The "sleeve" that I created contributes to the overall sturdiness of my device. My invention is attached at the lowermost portion of the skeg. This placement provides a unique protection to the propeller blades. When I accidentally installed my device at a slight tilt, I discovered that I increased my gas mileage, and got on plane much faster.

The ease of installation, low manufacturing cost, hydrofoil effect, savings on gas consumption, and increased protection offered to propellers and shear pins, are the major attributes of my device. I am not aware of any other invention that can offer all of these advantages.

HOW MY DEVICE IS MADE

The simplest way to explain the device would be to tell you that it consists of a fin and a sleeve. These two pieces of material are permanently formed together to make one new piece. The sleeve is then slipped up over the lowermost portion of the skeg on an existing marine motor and is attached via nuts, bolts and washers (or by using alternate attachment methods).

The leading edge of the fin is angled about ¼" to ½" higher than the trailing edge of the fin. Holes are predrilled into the sleeve portion of the device so that it can be attached to the skeg. The installation requires two or more holes to be drilled into the existing skeg. These holes must correspond with the placement of the holes that are predrilled into the sleeve of the device. I used two holes on each side in my prototype, but I may include four or more holes per side in order to be able to position the sleeve easily on different configurations of skegs.

I made my prototypes out of flattened pieces of steel or copper. The first piece that I made is the "fin." The fin is made in the approximate shape of a circle that has been cut in half. The sharp, or pointed edges of the fin are elonqated enough to match the width of the path of the rotating propeller blades on an marine motor. The exact measurements will vary as individual propeller guards will be made specifically to fit various size marine motors.

The second piece, or "sleeve" was made by folding an oblong piece of copper or steel and putting the two shortest ends together. I then welded a seam along this juncture. The sleeve now has an almost oval opening at each of the two ends. I then flattened the lowermost oval opening until the edges almost touch. The uppermost oval opening was fitted unto the lowermost portion of the skeg and fashioned into a sort of fitted "sleeve." With the sleeve removed from the skeg, I then placed the fin in a horizontal position and the sleeve in a vertical position. Next, I welded the entire lowermost portion of the sleeve onto the fin, exactly at midline in the semi-circle of the fin. The leading edge of the sleeve will be generally co-terminus with the leading edge of the fin. The trailing edge of the sleeve will not be able to reach the trailing edge of the fin because of the difference in measurements. I then drilled holes in each side of the sleeve in order to make an opening for the bolts insertion.

I am aware that some minor alterations of configuration might be required in order to permit this device to fit all makes and models of marine motors. This is because of the design differences of the skegs. This should only require minor alterations in the basic design. Basically, the alterations would involve the dimensions of the opening of the sleeve, the depth of the sleeve, and the width of the fin.

Although I made my prototypes out of copper or steel, I also envision making the device from very hard, resilient materials that can be poured into a mold. The main body of the device would then be a singular molded item.

I have also made this device with alternate sleeve fittings, i.e., a sleeve that has the trailing edge of the sleeve open, and a sleeve that has both the leading and trailing edges open. These alternatives allow the sleeve to fit onto the skeg more readily. See FIGS. 4 and 5 for visual examples of these alternate sleeve options.

HOW MY DEVICE IS USED

My device is simple to install and use. Simply mount the device by slipping the top opening of the sleeve over the lowermost portion of a skeg. The sleeve should fit snugly over the skeg. You then angle the device so that the leading edge of the fin is ¼" to ½" higher than the trailing edge of the fin.

Next, use a marking pen to mark the areas on the skeg that correspond to the holes that are predrilled in the sleeve of the device. Remove the device from the skeg. Then drill holes through the skeg at each pen-marked position. Slip the sleeve of the device up over the bottom of the skeg until the holes in the skeg and the holes in the device are aligned. Finally, attach the device to the skeg with the nuts, bolts, and washers. After installation, the device is ready to be used.

DESCRIPTION OF THE PREFERRED EMBODIMENTS

FIG. 1: displays an existing marine motor (12) with the device (13) shown as attached to the lowermost portion of the skeg (14), and beneath the propeller assembly (18) on a marine vessel motor. In this particular illustration, the sleeve (22) has been slipped up over the skeg (14), which is an integral part of an marine motor (12). This illustrates proper placement and/or mounting of the device (13) on the skeg (14).

Please note the three to five degrees of vertical pitch (19) that is portrayed in this illustration. The leading edge (23) of the fin (21) is angled from three to five degrees vertically higher than the trailing edge (24) of the fin (21).

FIG. 2: illustrates the device (13) as a whole and separate item. The generally flat fin (21) is affixed on the lower portion of the vertical sleeve (22) and extends laterally from the opposite sides of the sleeve (22) in substantially coplanar relationship. Please note: the trailing edge (24) of the fin (21) will be three to five degrees lower than the leading edge (23) of the fin (21). This vertical pitch is depicted as number (19) in FIG. 1. The laterally extending trailing, or pointed edges of the fin (15) and (16) are located forwardly of the propeller (18) (see FIG. 1). The leading edge (11) of the sleeve ( 22) will be generally co-terminus with the leading edge (23) of the fin (21). The outermost edges (15) and (16), and the leading edges (23), are arranged in the same general manner as is shown in FIGS. 1-4.

The embodiment in FIG. 2 portrays the positioning of the fin (21) as it is attached to the sleeve (22) via the welded seam (26). The leading edge (23) of the fin (21) is angled at a three to five degree pitch higher than the trailing edge (24) of the fin (21). The sleeve (22) and the fin (21) are welded together in a permanent fashion (or can be molded into one piece originally during manufacture). The sleeve (22) is intermediate with the right, or pointed edge (15) of the fin (21) and the left, or opposite pointed edge (16) of the fin (21).

There are four bolt holes (6) illustrated in this drawing. Since each side of the sleeve (22) will have a corresponding amount of bolt holes (6), then the total will be doubled, or in this particular embodiment, a total of eight holes per device. The placement of these sets of holes will vary in different embodiments of the device. Two bolts (see (7) in FIG. 3) will be inserted through the sleeve (22) and the skeg (14) (see FIG. 1) using two sets of the bolt holes (6). The two extra bolt holes that will remain unused are simply there to offer choice or ease of placement. Two nuts (8) and four washers (17) (see FIG. 3, (8) and (17) are used to complete the process of attachment of the device (13) to the skeg (14) (see FIG. 1).

The sleeve (22) can alternately be welded for adjoining seams at either the leading edge (11), or the trailing edge (10) of the sleeve (22). Seams at both edges (11 and 10) are possible, as well as the option of leaving one or both seams open. The uppermost portion of the sleeve (22) remains open (9) to accept the lowermost portion of the skeg (14) (see FIG. 1).

FIG. 3: shows a top view plan of the device (13) as it would be viewed previous to installation on a marine vessel. This drawing also provides an illustration as to placement of the bolts (7), nuts (8), and washers (17), and illustrates clearly the manner of entrance and exit through the sleeve (22). The skeg (14) (see FIG. 1) is not shown in this particular illustration, however, please be aware that the skeg (14) would be inserted into the sleeve (22) before the process of attachment.

FIG. 4: is exactly the same as FIG. 2 with the singular exception that in this illustration the trailing edge of the sleeve (shown previously as (10) in FIG. 2) is now left open and unattached for ease of installation and is now depicted as number (20) in FIG. 4. The fin (21), the sleeve (22), the trailing edge (24) of the fin, and the leading edge (23) of the fin are all depicted in this illustration for ease of orientation.

FIG. 5: is a duplicate of FIG. 4 with one exception: the sleeve in this illustration has open ends on both the trailing (20) and the leading (25) edges. Again, the fin (21), the sleeve (22), the trailing edge (24) of the fin, and the leading edge (23) of the fin are all depicted in this illustration.

What is claimed is:

1. A propeller guard for mounting on the lowermost portion of a skeg of a marine drive having propeller blades, said guard comprising an oval shaped sleeve with a vertical longitudinal axis, a top and a bottom, said top being open as to allow the sleeve to be slipped over said skeg, said guard further comprising a generally flat fin attached to and closing said bottom of said sleeve, with said fin having an angle of pitch of 3 to 5 degrees to said vertical longitudinal axis of said sleeve and extending downward and rearwardly, said fin having a trailing edge at least as wide as the circumference of the rotational path of said propeller blades and said guard further comprising means for readily attaching and detaching said sleeve to said skeg.

2. The propeller guard as recited in claim 1 wherein said sleeve has an open trailing edge.

3. The propeller guard as recited in claim 1 wherein said sleeve has an open trailing edge and an open leading edge.

* * * * *